US009713230B2

(12) United States Patent
Kottek

(10) Patent No.: US 9,713,230 B2
(45) Date of Patent: Jul. 18, 2017

(54) METHOD FOR CONTROLLING A LAMP HAVING A PLURALITY OF SUB-UNITS

(71) Applicant: ZUMTOBEL LIGHTING GMBH, Dornbirn (AT)

(72) Inventor: Thomas Kottek, Lustenau (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 14/783,325

(22) PCT Filed: Apr. 10, 2014

(86) PCT No.: PCT/EP2014/057288

§ 371 (c)(1),
(2) Date: Oct. 8, 2015

(87) PCT Pub. No.: WO2014/167061

PCT Pub. Date: Oct. 16, 2014

(65) Prior Publication Data

US 2016/0073480 A1 Mar. 10, 2016

(30) Foreign Application Priority Data

Apr. 12, 2013 (DE) ..... 10 2013 206 536

(51) Int. Cl.
*H05B 37/02* (2006.01)
*G08C 17/00* (2006.01)

(52) U.S. Cl.
CPC ..... *H05B 37/0254* (2013.01)

(58) Field of Classification Search
None
See application file for complete search history.

(56) References Cited

U.S. PATENT DOCUMENTS

2002/0040452 A1* 4/2002 Birk ..... H04L 12/40189 714/43
2006/0193133 A1 8/2006 Von Der Brelie
2008/0036401 A1* 2/2008 Erhardt ..... H05B 37/0245 315/349

(Continued)

FOREIGN PATENT DOCUMENTS

CN 101572983 11/2009
CN 102222469 10/2011

(Continued)

OTHER PUBLICATIONS

International Search Report for PCT/EP2014/057288, English translation attached to original, Both completed by the European Patent Office on Jul. 31, 2015, All together 5 Pages.

(Continued)

*Primary Examiner* — Dedei K Hammond
(74) *Attorney, Agent, or Firm* — Brooks Kushman P.C.

(57) ABSTRACT

A method for controlling a lamp, which has a plurality of controllable sub-units is disclosed. First control information concerning the light output of only some of the controllable sub-units is fed to a control unit of the lamp on the input side, wherein the control unit determines a second control information concerning the light output of all sub-units on the basis of the first control information and transmits the second control information to the sub-units connected on the output side.

16 Claims, 2 Drawing Sheets

(56) References Cited

U.S. PATENT DOCUMENTS

| | | | |
|---|---|---|---|
| 2010/0109570 | A1 | 5/2010 | Weaver |
| 2012/0001554 | A1 | 1/2012 | Leadford et al. |
| 2012/0139823 | A1 | 6/2012 | Fujiwara et al. |
| 2012/0212466 | A1 | 8/2012 | Kohtoku |
| 2014/0139136 | A1 | 5/2014 | Varga et al. |

FOREIGN PATENT DOCUMENTS

| | | |
|---|---|---|
| CN | 102323528 | 1/2012 |
| CN | 202171232 | 3/2012 |
| DE | 19507459 | 9/1996 |
| DE | 102011018808 | 10/2012 |
| DE | 202012102609 | 12/2012 |
| WO | 2009029197 | 3/2009 |

OTHER PUBLICATIONS

Chinese Search Report for Chinese Application No. CN 2014800201193, Completed by the Chinese Patent Office, Dated Oct. 25, 2016, 1 Page.

* cited by examiner

METHOD FOR CONTROLLING A LAMP HAVING A PLURALITY OF SUB-UNITS

CROSS-REFERENCE TO RELATED APPLICATION

This application is the U.S. national phase of PCT Application No. PCT/EP2014/057288 filed on Apr. 10, 2014, which claims priority to DE Patent Application No. 10 2013 206 536.1 filed on Apr. 12, 2013, the disclosures of which are incorporated in their entirety by reference herein.

The present invention relates to a method for actuating a luminaire that has a plurality of modules or subunits that are individually controllable in terms of their light emission. In addition, the invention relates to a control unit for a correspondingly embodied luminaire and to a luminaire of this kind From lighting technology, it is known practice to incorporate luminaires into a larger lighting system in which the luminaires are actuated by a central command transmitter. By way of example, the central command transmitter may be formed by a central control unit within a building or building complex or else by an operator control unit, for example arranged in a room, that allows a user to adjust the luminosity of the luminaires within the room. In any case, this makes it possible to avoid complex individual wiring of the luminaires to corresponding individual operator control devices.

Usually, the luminaires in such a lighting system are connected to a common power supply system and to a common communication system. A currently popular approach to actuating luminaires involves the use of what is known as the DALI protocol. In this case, a two-wire line, what is known as the DALI bus, is used to transmit to the luminaires digital control commands that contain particularly luminosity setpoint values that appropriate control units of the luminaires then take as a basis for operating the associated light sources. The individual actuation of a single luminaire is made possible in this case by virtue of said luminaire being allocated, during startup of the system, an operating address that is then added to the DALI command in order to denote the relevant luminaire.

Whereas, in the past, primarily fluorescent lamps or the like were used as light sources for lighting purposes, LED-based light sources have increasingly been used in recent times. In comparison with the elongate fluorescent lamps, LEDs are much smaller, which means that the corresponding lighting units can also be of more compact design. In this case, larger luminaires often consist of a plurality of modules, for example arranged in a row, that can each be controlled independently of one another, that is to say can assume an individual luminosity for light emission.

The actuation of such luminaires having a plurality of subunits or light modules is found to be problematic insofar as, by way of example, the standard DALI control commands can be used to transmit only single luminosity setpoint values in each case. This means that if the single modules or subunits of a luminaire each assume different luminosities, it is necessary for individual commands to be transmitted for each module. Such an approach is not only associated with a relatively high level of outlay in terms of the volume of data to be transmitted but also requires each module of the luminaire to be allocated an individual DALI operating address. Since only 64 different addresses can be allocated within a DALI bus, this results in the number of luminaires that can actually be incorporated into the system having a plurality of controllable subunits of this kind being markedly reduced.

The present invention is therefore based on the object of specifying a solution to the problem described above. In particular, the aim is to provide the opportunity to be able to actuate luminaires having a plurality of controllable subunits or light modules efficiently.

The solution according to the invention involves the idea of transmitting control information to a control unit of the luminaire just for some of the controllable luminaire subunits, said control information relating to the light emission of said units. The output side of the control unit has all the subunits connected to it, with the control unit taking the control information received at the input side as a basis for ascertaining control information that is suitable for all the subunits and then using this control information to actuate the subunits. The approach according to the invention results in the extent of the commands that need to be transmitted to the input side of the luminaire—for example in accordance with the DALI standard—being able to be kept down, since only information for a small number of subunits needs to be transmitted.

However, this information is then used to actuate all the units. A consequence that results therefrom is additionally also that the subunits of the luminaires need to use or engage a much smaller number of available DALI operating addresses, so that overall the number of corresponding luminaires that can be incorporated into a lighting system can be increased.

Accordingly, the present invention proposes a method for actuating a luminaire that has a plurality of controllable subunits, wherein the input side of a control unit of the luminaire is supplied with first control information that relates to the light emission of just some of the controllable subunits, and wherein the control unit takes this first control information as a basis for ascertaining second control information that relates to the light emission of all the subunits, and transmits this second control information to the subunits connected to the output side.

In addition, the invention proposes a control unit for a luminaire that has a plurality of controllable subunits, wherein the control unit has:

a) means for input-side reception of first control information that relates to the light emission of just some of the controllable subunits, b) means for determining second control information that relates to the light emission of all the subunits, on the basis of the first control information, and c) means for transmitting the second control information to the subunits connected to the output side.

In this case, the different control information can be transmitted particularly also using different communication standards. As already mentioned, provision is preferably made for control information to be transmitted to the input side of the luminaire in accordance with the DALI standard. It is then no longer necessary for the output-side actuation of the luminaire subunits to be effected within the context of the DALI standard, however. Instead, serial actuation or the like could also be used for this purpose. However, it is essential that the transmission of the second control information can also involve the control unit of the luminaire transmitting individual control values for the light emission to the subunits. In this case, a particularly preferred type of actuation of the subunits by the control unit of the luminaire involves the control signal being supplied to the subunits continuously and returned in a loop.

The result of this is that the control unit is rendered able to automatically identify how many modules or subunits the luminaire has. This information can then be considered, if need be, when ascertaining the second control information.

As already mentioned, such subunits are normally arranged in a regular arrangement. By way of example, corresponding subunits can be arranged linearly or in a row one behind the other. In this case, provision is then preferably made for the first control information transmitted to the luminaire to relate to the light emission from subunits that are situated at what are known as supporting points for the arrangement. By way of example, these supporting points may be the two end positions in the arrangement of the subunits. Preferably, three supporting points are provided in a serial arrangement, with the middle subunit or one of the two middle subunits also finding a third supporting point in addition to the two end positions. The control values for the luminosity of these subunits, which control values are transmitted to the luminaire within the context of the first control information, are then converted as appropriate for the units situated between the supporting points, this being able to be accomplished within the context of interpolation or a linear rise or fall in luminosity, for example. That is to say that the luminaire subunits situated between the supporting points then assume luminosities that are chosen such that there is a constant rise or fall in the luminosity over the entire length of the arrangement. This attains a homogeneous appearance for the luminaire in an overall view.

In a further advantageous embodiment of the invention, provision may additionally be made for the power supply for the subunits of the luminaire to be provided by a power supply unit that is isolated from the control unit. Depending on whether or not the control unit of the luminaire establishes that the subunits are meant to emit light, the control unit can then break or make an input-side connection from the power supply unit to the general power supply. In a switched-off state of all the modules, the power supply for the power supply unit is thus also interrupted, so that only the control unit itself then needs to be supplied with power. The power consumption of the luminaire in such a standby state can thus be reduced to an extreme extent, as a result of which said power consumption is even below one watt.

The invention will be explained in more detail below with reference to the accompanying drawing, in which.

Figure 1:
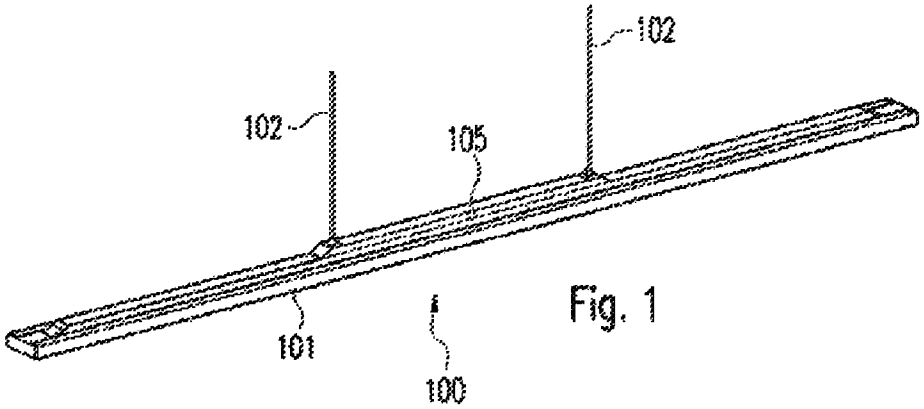
FIG. 1 shows a perspective view of a luminaire that has a plurality of controllable subunits that are actuated in accordance with the method according to the invention.
Figure 2:
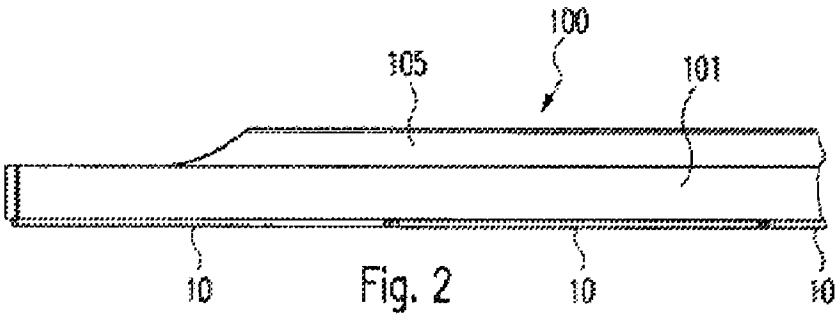
FIG. 2 shows an enlarged side view of an end region of the luminaire from FIG. 1.
Figure 3:
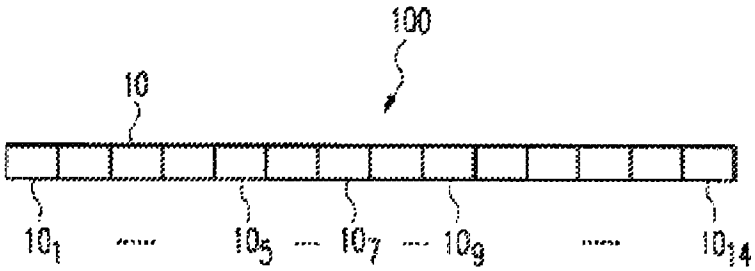
FIG. 3 shows the view of the underside of the luminaire.

The luminaire 100 shown in FIGS. 1 to 3 consists of an elongate carrier element 101 that, in the exemplary embodiment shown, is suspended by means of two cables 102 on a ceiling, which is not shown. Naturally, the manner in which the luminaire 100 is mounted is of no significance to the present invention and can accordingly also be fashioned otherwise.

The main function of a carrier element 101 is to hold a plurality of subunits or light modules. These subunits 10 are attached to the carrier element 101 from the underside and affixed thereto in a manner that is not shown in more detail, for example by means of appropriate latching elements or using a magnetic retainer. As will be explained in more detail later, all the subunits 10 are supplied with power and each have light sources that are individually actuatable. Preferably, the light sources of the subunits 10 can be formed by LEDs, but the invention is not necessarily limited to such types of light sources.

In a view of the luminaire 100 from below, the appearance shown in FIG. 3 is then obtained, in which a plurality of subunits 10 of the same type can be identified one behind the other in the longitudinal direction of the carrier element 101, a total of 14 subunits being used in total in the present case. Furthermore, the luminaire 100 shown in the figures also has light sources for indirect light emission that are arranged on the top of the carrier element 101. In the exemplary embodiment shown, two walls 105 that bound an intermediate channel extend in the longitudinal direction on the top of the carrier element 101. The light sources for indirect light emission may then be arranged within this channel, said light sources being formed by elongate fluorescent lamps or elongate LED boards, for example. In addition, the channel can also be used to hold electronic components, particularly a control unit and corresponding power supply units for actuating and supplying power to the subunits 10 and also to the light sources for the indirect light emission.

The different subunits 10 are preferably in an identical form, but do not have to assume an identical luminosity during operation of the luminaire 100. Instead, it is entirely the aim for the subunits 10 to emit different amounts of light, depending on the way in which the luminaire 100 is meant to be used for lighting or what overall appearance is desired. In this case, the luminaire 100 itself is meant to be part of a larger lighting system, with, by way of example, a central control unit or an operator control device transmitting external commands to the luminaire 100 in order to set or influence the light emission of the subunits 10.

Before the manner of actuation of the modules or subunits 10 is explained below in detail, the basic principle of the approach according to the invention will first of all be presented.

Accordingly, individual control commands for the light emission are not transmitted to the luminaire 100 for every single subunit 10. This is because this would mean that setting the luminosities of all the modules 10 would require a total of 14 commands to be transmitted and also possibly additionally a further command for the indirect light emission, which would firstly be associated with a high level of outlay in terms of time and the volume of data to be transmitted and would secondly also result in the luminaire engaging at least 14 different DALI addresses if the DALI standard were used for actuating the luminaire 100, for example.

Instead, the present invention provides for just three modules, in the present case the two outer modules $\mathbf{10}_1$ and $\mathbf{10}_{14}$ and one of the two middle modules $\mathbf{10}_7$, to form what are known as reference positions or supporting points for the arrangement of the subunits 10. For these three supporting point subunits $\mathbf{10}_1$, $\mathbf{10}_7$ and $\mathbf{10}_{14}$, external control information is then transmitted to the luminaire 100, said control information prescribing the luminosity desired for these three units. Thus, three commands having appropriate luminosity setpoint values are transmitted to the luminaire 100 and stipulate the light emission at these supporting points. The luminaire 100 itself, to be precise a control unit that will be explained in more detail later, then takes these control values for the three supporting points as a basis for ascertaining luminosity setpoint values for all the other subunits 10 too and then actuates said control units accordingly. To be precise, provision is made for the control unit of the luminaire 100 to be responsible for actuating all the subunits $\mathbf{10}_1$ to $\mathbf{10}_{14}$, the externally prescribed control values for the supporting point subunits $\mathbf{10}_1$, $\mathbf{10}_7$ and $\mathbf{10}_{14}$ being adopted directly and suitable control values being computed for all the further subunits 10. In this case, the control unit does not operate the light sources of the control units 10 directly but rather again produces commands that correspond to these control values and that are transmitted to the subunits and converted therein accordingly. The subunits thus again have means internally that they can use to receive and process the commands that are output by the control unit.

By way of example, it would be conceivable for luminosity setpoint values to be computed for the subunits 10 situated between two supporting points such that a linear luminosity change takes place between the supporting points. Computation of suitable luminosity setpoint values by means of interpolation or other suitable compensatory curves would also be conceivable provided that a constant rise or fall in luminosity is attained thereby as seen over the entire length. In any case, sudden changes in luminosity between two adjacent subunits should be avoided.

Thus, if a luminosity of 100% is prescribed for the middle supporting point or its subunit $\mathbf{10}_7$ and the external control information supplied to the luminaire 100 stipulates that the subunits $\mathbf{10}_1$ and $\mathbf{10}_{14}$ at the outer supporting points are meant to be operated only at a luminosity of 20%, the control unit for all the further subunits 10 would compute control values that ultimately result in the luminosity of 20% first of all rising uniformly to 100% in the left-hand half and then in turn falling to 20% toward the outer end in the right-hand half, as seen over the entire length of the luminaire 100.

Naturally, there is no mandatory provision for each arrangement of subunits to have to have three supporting points. Instead, the number of supporting points could also be increased or reduced, depending on how the individual behavior of the units then needs to be influenced or how many DALI operating addresses are available for use. If only two supporting points are used, for example, these could be formed by the two outermost subunits $\mathbf{10}_1$ and $\mathbf{10}_{14}$, for example, in which case a linear rise or fall in luminosity is determined for all the intermediate subunits. Use of just a single supporting point would also be conceivable in the extreme case, this supporting point then preferably being formed by a middle subunit and the luminosity of all the further subunits then being set such that it falls to a prescribed value toward the two end positions, for example.

Figure 4:
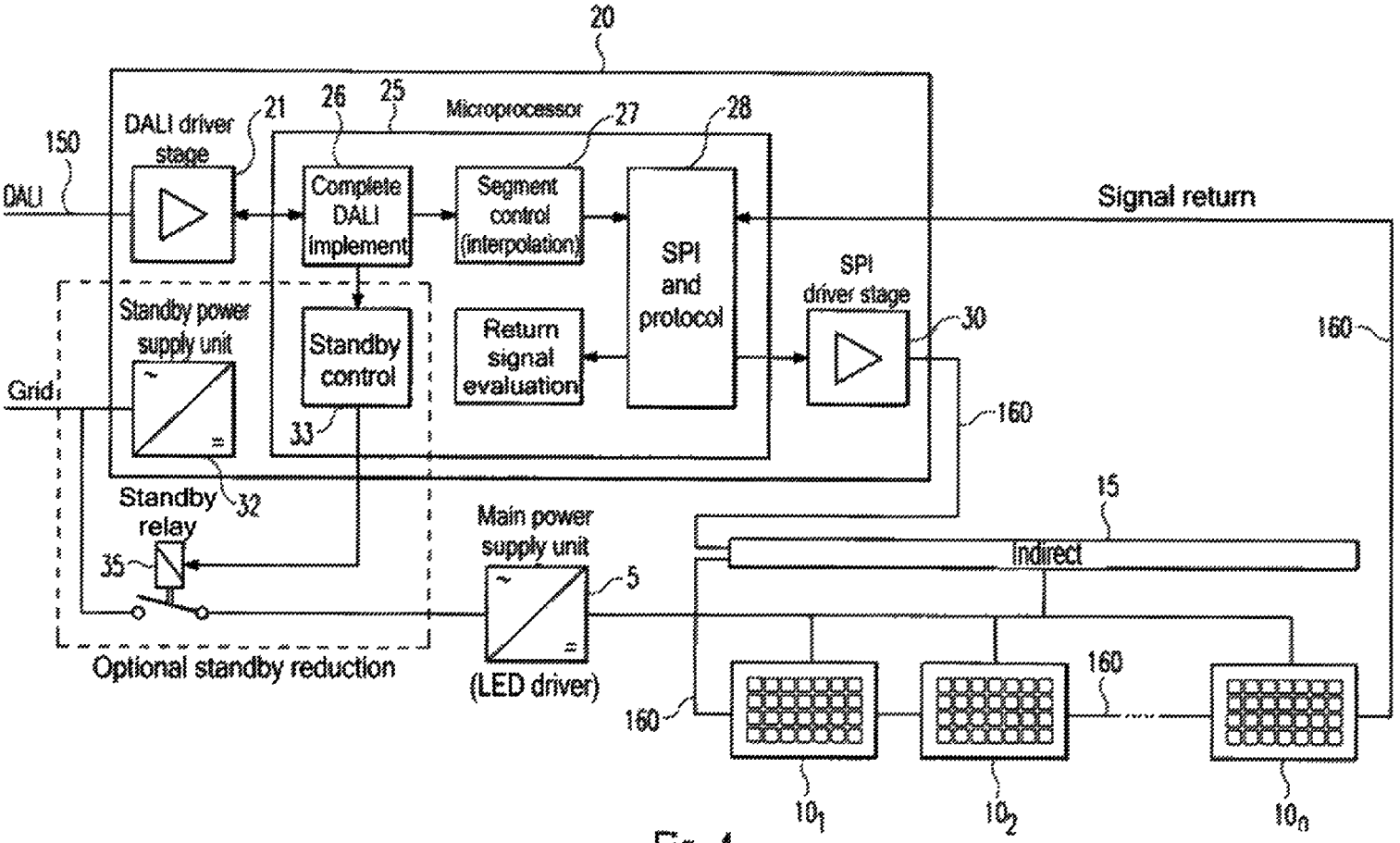
FIG. 4 shows a diagram of the actuation of the subunits of the luminaire in accordance with the method according to the invention.

The previously described fundamental methods according to the invention for actuating the luminaire subunits can be implemented using an arrangement as shown in FIG. 4, for example. It is first of all possible to identify the subunits $\mathbf{10}_1$ to $\mathbf{10}_n$, which each contain the light sources 11 already mentioned, it being assumed in the present case that the light sources are each formed by LEDs 11 arranged in a matrix with corresponding optical systems. These subunits $\mathbf{10}_1$ to $\mathbf{10}_n$ are collectively connected to a power supply unit 5 for supplying power. In addition, said subunits are connected to the output side of a control unit 20 of the luminaire. In this case, this control unit 20 undertakes the task of actuating the subunits $\mathbf{10}_1$ to $\mathbf{10}_n$ connected to the output side on the basis of first control information supplied to the input side.

In this case, provision is made for the input side of the control unit 20 to receive first control information in accordance with the DALI standard. The control unit 20 is what is known as a DALI controller, which is connected in the usual manner to a DALI bus 150 that is indicated in FIG. 4. The output-side control of the subunits $\mathbf{10}_1$ to $\mathbf{10}_n$, on the other hand, is effected preferably not by means of the DALI standard but rather in accordance with another type of communication. In the exemplary embodiment shown, all the subunits $\mathbf{10}_1$ to $\mathbf{10}_n$ are connected to a control line 160 that extends through all the subunits $\mathbf{10}_1$ to $\mathbf{10}_n$ and is returned to the control unit 20 again in the manner of a loop. In this case, the control commands via this line 160 are preferably transmitted serially, with the control unit 20 then providing individual control information for each subunit 10 and transmitting said information thereto. As can additionally be identified in FIG. 4, the control unit 20 is also responsible for actuating the light sources for the indirect lighting 15, which results in the line 160 also being routed through this unit 15 and in the latter furthermore also being connected to the power supply unit 5.

Thus, for the purpose of converting the DALI commands supplied to the input side, the control unit 20 first of all has a DALI driver stage 21 that is connected to a microprocessor 25. The latter is connected to the DALI driver stage via a first unit 26, this unit 26 being responsible for the communication via the DALI bus 150, e.g. with a central control unit of the system or an operator control device. The received DALI commands are then supplied to a further unit 27, which is responsible for the actual computation of the control values for the subunits $\mathbf{10}_1$ to $\mathbf{10}_n$. In the approach described above, the unit 27 takes the luminosity setpoint values transmitted for the supporting point subunits as a basis for computing control values for all the subunits $\mathbf{10}_1$ to $\mathbf{10}_n$ and forwards this information to a further unit 28. The output side of the latter forwards information to a driver stage 30, which then performs the serial transmission of the second control information to the unit for the indirect lighting 15 and also to the subunits $\mathbf{10}_1$ to $\mathbf{10}_n$.

Furthermore, this serial data transmission to the subunits $\mathbf{10}_1$ to $\mathbf{10}_n$ and the light sources for the indirect lighting 15 also results in a signal return involving the control unit 20 being rendered able to automatically identify how many units are connected to the output side. By way of example, when the luminaire 100 is started for the first time, provision could be made for the control unit 20 to transmit data packets to the output side until a signal finally arrives at the unit 28 again within the context of the return. As a result, it is possible to establish how many modules in total are connected to the output side. If the control unit 20 is additionally configured such that there are three supporting points, for example, they can automatically establish or determine which subunits $\mathbf{10}_1$ to $\mathbf{10}_n$ form these supporting points.

By way of example, if it is thus identified that there are a total of n subunits (that is to say when a total of n+1 output-side units have been ascertained by taking account of the means for the indirect lighting 15), the subunits $\mathbf{10}_1$ and $\mathbf{10}_n$ are stipulated as outer reference positions or supporting points and the module $\mathbf{10}_m$, with a) $m=(n+1)/2$ for uneven n or b) $m=n/2$ for even n, is stipulated as middle reference position or supporting point. Since the control unit 20 simultaneously also knows the number of subunits situated between the supporting points subunits, it can then compute control values for all the subunits $\mathbf{10}_1$ to $\mathbf{10}_n$ in the above-described manner according to the invention and transmit said control values thereto.

Hitherto, there has been no mention of the actuation of the light sources for the indirect lighting 15. One option in this case is for said light sources to assume a prescribed luminosity if the subunits $\mathbf{10}_1$ to $\mathbf{10}_n$ are activated. However, it would also be conceivable, in the same way, for the control unit 20 to take the control values computed for the subunits $10_1$ and $10_n$ as a basis for determining a—for example mean—control value for the indirect light emission and to actuate the module 15 accordingly.

A further special feature of the arrangement in FIG. 4, which will be mentioned in conclusion, is the opportunity to reduce the power consumption in a standby mode of the luminaire 100. As can be seen from FIG. 4, the control unit 20 has an internal power supply unit 32 that, like the power supply unit 5 for the light units, is connected to the general power supply but is embodied in isolation therefrom. If the microprocessor 25 identifies that, on the basis of the DALI control commands supplied to the input side, the luminaire 100 needs to remain switched off overall, the relevant information is forwarded to a control block 33 that is responsible for actuating a relay 35 that connects the power supply unit 5 to the general power supply. The control block 33 then uses the relay 35 to interrupt the power supply to the power supply unit 5, so that the latter, together with the subunits $10_1$ to $10_n$ and 15, consumes no further power at all. In such a standby state, exclusively the control unit 20 means that there is thus just a low power consumption, which can be kept below one watt, however, which means that the luminaire, viewed as a whole, has an extremely low power consumption in the standby state.

Finally, it should be noted that although the actuation, according to the invention, of the subunits has been explained hitherto for a linear arrangement or a serial arrangement of the subunits, the concept can also be extended to any other type of arrangements in the same way. In particular, luminaires in which the subunits are arranged in the manner of a matrix would naturally also be conceivable, in which case suitable control information for operating all the subunits can in turn be computed on the basis of appropriate first control information that relates to the light emission of particular supporting points.

The invention claimed is:

1. A method for actuating a luminaire that has a plurality of controllable subunits, the method comprising:

supplying an input side of a control unit of the luminaire with first control information that relates to light emission of just some of the controllable subunits, generating in the control unit second control information that relates to the light emission of all the subunits based on the first control information, and transmitting this second control information to the subunits connected to an output side of the control unit.

2. The method as claimed in claim 1, wherein the first control information is transmitted to the control unit and the second control information is transmitted to the subunits using different communication standards.

3. The method as claimed in claim 2, wherein the first control information is transmitted in the form of DALI commands.

4. The method as claimed in claim 2, wherein the second control information is transmitted to the subunits within the context of a serial data transmission.

5. The method as claimed in claim 1, further comprising automatically identifying using the control unit the number of controllable subunits, wherein the step of generating the second control information takes into account of the number of identified subunits.

6. The method as claimed in claim 1, wherein the subunits have a regular linear arrangement and the first control information relates to the light emission from subunits situated in reference positions, particularly contains luminosity setpoint values for the subunits situated at the reference positions.

7. The method as claimed in claim 6, wherein the control unit determines the second control information by interpolation.

8. The method as claimed in claim 1, further comprising providing a power supply for the subunits by a power supply unit that is isolated from the control unit, wherein the control unit uses the received and forwarded first and second control information as a basis for breaking or making an input-side connection from the power supply unit to the general power supply.

9. A control unit for a luminaire that has a plurality of controllable subunits, the control unit comprising:

an input-side driver which receives first control information that relates to the light emission of just some of the controllable subunits and generates an input communication, a microprocessor configured to generate second control information that relates to the light emission of all the subunits, on the basis of the first control information, and an output driver communicating with the microprocessor for transmitting the second control information to the subunits.

10. The control unit as claimed in claim 9, wherein the input-side driver which receives the first control information and the output driver which transmits the second control information communicate using different communication standards.

11. The control unit as claimed in claim 10, wherein the first control information is DALI commands.

12. The control unit as claimed in claim 10, wherein the output driver is configured to transmit the control information within the context of a serial data transmission.

13. The control unit as claimed in claim 9, wherein the control unit automatically identifies the number of controllable subunits and ascertains the second control information by taking account of the number of identified subunits.

14. The control unit as claimed in claim 9, wherein the subunits have a regular linear arrangement and the first control information relates to the light emission from subunits situated at reference positions, wherein the control unit is designed to determine the second control information using interpolation.

15. The control unit as claimed in claim 9, further comprising a power supply for the subunits provided by a power supply unit that is isolated from the microprocessor, wherein the microprocessor is configured to take the received and forwarded first and second control information as a basis for breaking or making an input-side connection from the power supply unit to a general source of power.

16. A luminaire having a plurality of controllable subunits and a control unit as claimed in claim 9.

* * * * *